US011078893B2

(12) United States Patent
Bradley et al.

(10) Patent No.: US 11,078,893 B2
(45) Date of Patent: Aug. 3, 2021

(54) FOOT PUMP AND STOW SYSTEM

(71) Applicants: Reason Bradley, Mill Valley, CA (US); Gregory Staples, Petaluma, CA (US)

(72) Inventors: Reason Bradley, Mill Valley, CA (US); Gregory Staples, Petaluma, CA (US)

( * ) Notice: Subject to any disclaimer, the term of this patent is extended or adjusted under 35 U.S.C. 154(b) by 47 days.

(21) Appl. No.: 16/698,454

(22) Filed: Nov. 27, 2019

(65) Prior Publication Data

US 2020/0173428 A1 Jun. 4, 2020

Related U.S. Application Data

(60) Provisional application No. 62/773,869, filed on Nov. 30, 2018.

(51) Int. Cl.
*F04B 9/14* (2006.01)
*F04B 33/00* (2006.01)
*F04B 39/12* (2006.01)

(52) U.S. Cl.
CPC ..... *F04B 33/005* (2013.01); *F04B 9/14* (2013.01); *F04B 33/00* (2013.01); *F04B 39/121* (2013.01)

(58) Field of Classification Search
CPC ..... F04B 9/14; F04B 33/00; F04B 33/005; F04B 39/121; F04B 39/123
See application file for complete search history.

(56) References Cited

U.S. PATENT DOCUMENTS 2,901,980 A * 9/1959 Jordan ..... F04B 9/14 417/495
9,234,513 B2 * 1/2016 Cheng ..... F04B 9/14
2007/0110589 A1 * 5/2007 Marafino ..... F04B 33/005 417/231
2012/0275944 A1 * 11/2012 Chuang ..... F04F 1/06 417/442

FOREIGN PATENT DOCUMENTS

JP 2006226270 A * 8/2006

OTHER PUBLICATIONS

Kickstarter, Stompump Tire Inflator for your Bicycle or any Tire by Stompump Team, Apr. 11, 2018, pp. 1-17 (Year: 2018) https://www.kickstarter.com/projects/gate5/stompump-tire-inflator-for-your-bicycle-or-any-tir/description.*

* cited by examiner

*Primary Examiner* — Dominick L Plakkoottam

(57) ABSTRACT

A low-profile, lightweight, portable, frame-mountable, single-acting reciprocating, positive-displacement foot pump for bikes, configured for stowing in a docking frame mountable on standard water bottle cage bosses. The squat type design has a large displacement volume and a replaceable air filter disposed under the pump cap in the intake air paths to keep operating components clean and dust free.

15 Claims, 8 Drawing Sheets

FOOT PUMP AND STOW SYSTEM

CROSS REFERENCES TO RELATED APPLICATIONS

The present application claims the benefit of U.S. Provisional Application Ser. No. 62/773,869, filed Nov. 30, 2018 (Nov. 30, 2018) and is incorporated in its entirety herein by reference.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

SEQUENCE LISTING

Not applicable.

BACKGROUND OF THE INVENTION

Field of the Invention

The present invention relates most generally to portable air pumps for inflating pneumatic tires and other articles (e.g., balls for sports). More particularly the invention relates to floor foot pumps, and still more particularly to a floor foot pump for bicycle tires with a stow system adapted for installation on the water bottle cage bosses common on all nearly all contemporary bikes.

Background Discussion

When bicycling, over time flats are inevitable, whether road cycling, touring, brevet riding, off road terrain riding, downhill riding, cyclo-cross, gravel riding, E-bicycling, jump track riding, track or flatland BMX riding, freight or messenger riding, and so forth. Of course, "inevitable" does a disservice to the annoyance: short of an injury-causing crash or a riding partner who decides to be bad company, nothing could be more frustrating or disruptive. It's one of those irritations in life that needs to be short-lived, particularly when the flat occurs in race conditions or inclement weather—worse, both. Consequently, numerous portable flat repair kits, pumps, and $CO_2$ inflators have been devised for repairing flats out on the road or trail as efficiently and as quickly as possible.

With respect to prior art portable pumps, they are traditionally designed to be lightweight, rugged, small, easily mounted on a bike frame, and they generally operate as intended—meaning they are serviceable in putting air into a tire, at least to a point and over time. However, in balancing the desire to meet several of the first listed characteristics, efficiency in operation—pumping performance—has not been given due weight. From the perspective of the present inventors, portable prior art frame mounted road pumps are simply inefficient, particularly those characterized as mini or pocket pumps. They are slow and tiring to use (no pun intended).

$CO_2$ inflators are hardly an improvement: they are prone to leaks if not properly seated on the tire valve, the charge can therefore be wasted (with no recourse), it is difficult to meter out the right fill amount, the cartridges are environmentally unsound as they are disposed of after a one-time use (they are therefore expensive), and they stow in pockets or pouches rather than on a bike frame. Moreover, most cyclists never carry the $CO_2$ inflators alone because of the risk of failure—i.e., they also carry a pump, so they do not save weight.

SUMMARY OF THE INVENTION

The present invention is a lightweight, portable, frame-mountable and stowable foot pump for bikes. The pump is adapted for stowing in a docking frame which is, in turn, adapted for connection to the frame on standard water bottle cage bosses. The pump is a low profile, large circumference "squat" type design that has a large displacement volume (approximately 78 $cm^3$) and thus high pump performance. Testing shows it to be roughly 3× faster than hand pumps, and with its very short stroke actuated with small leg extensions, it is comparable in efficiency to many floor pumps.

The inventive pump is a single-acting reciprocating positive-displacement foot pump and has a very low profile even in the most extended position prior to a delivery (compression) stroke of the pump. Accordingly, stability and balance during operation are easy to maintain. The pump includes a replaceable air filter disposed under the pump cap and in the intake air paths; accordingly, the filter keeps the operating components of the pump interior clean and free of dust and debris. The pump rod for the pump piston includes a removable cap that exposes a hollow interior useful for storing patch repair kits or similarly sized articles. Push-to-connect fittings and a single reversible chuck for presta and Schrader valves make deployment and stowing fast and easy.

DETAILED DESCRIPTION OF THE INVENTION

Figure 1:
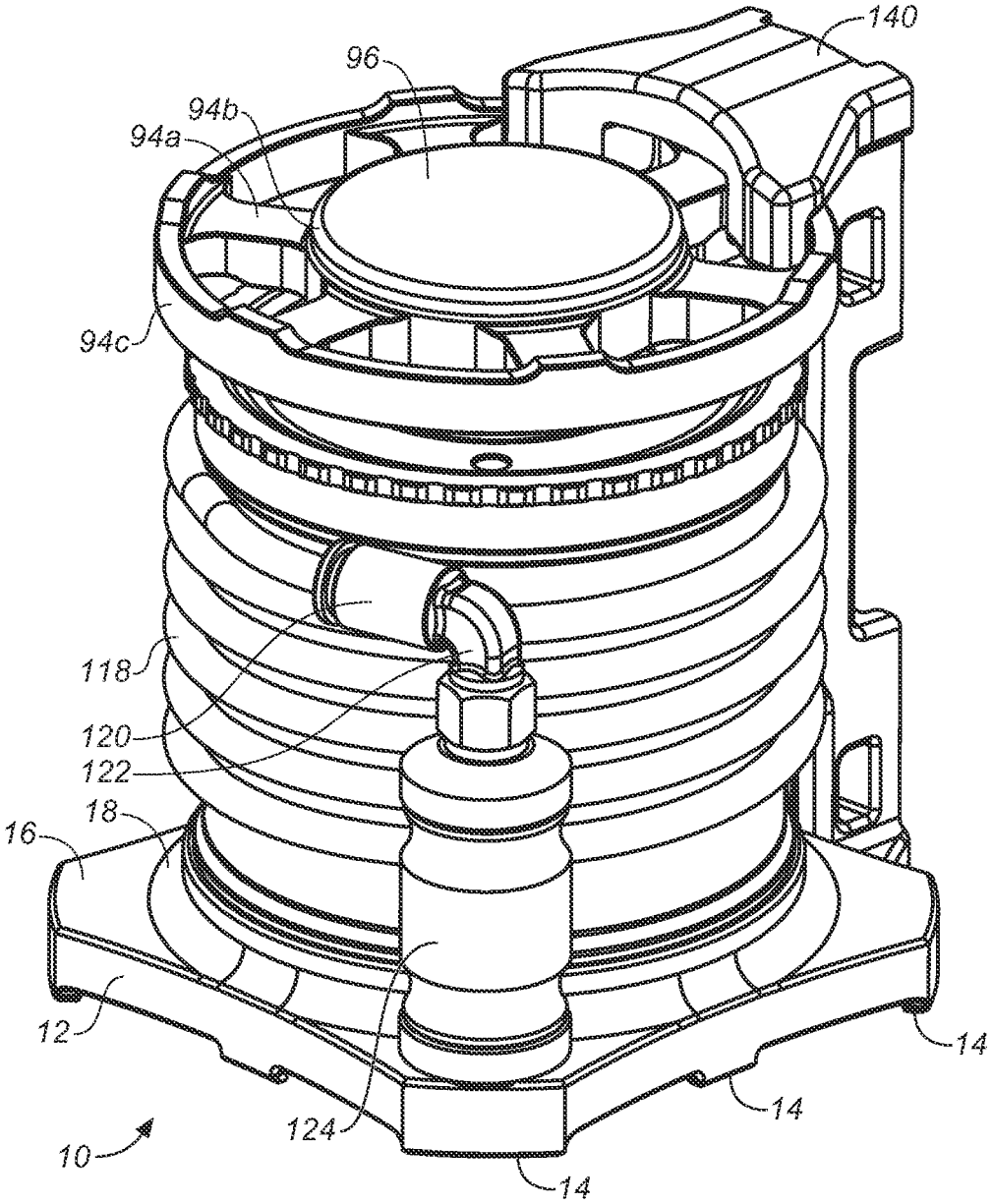
FIG. 1 is an upper front right perspective view of the floor foot pump of the present invention, showing the pump installed on the mounting frame ("docking frame")

Referring first to FIGS. 1 through 6, wherein like reference numerals refer to like components in the various views, there is illustrated therein a new and improved floor foot pump for bicycles and other pneumatic articles, the pump generally denominated 10 herein. As can be seen in the various views, the pump includes in its most general aspect a pump base 12, having a plurality of feet 14 configured to share a common planar bottom that rests stably on a flat surface. In embodiments, the base may be generally square with four large (corner feet) and four minor medial feet disposed between each corner foot. The number and spacing, however, are non-essential and as long as stability during operation is not compromised, any of a number of base configurations may be suitable.

The top 16 of the base 12 includes a raised annular collar 18 having female threads 20 adapted to threadably couple to a pump cylinder 22 having male threads 24 on its lower end 26. The pump cylinder screws onto the base at the raised collar and captures and compresses a square O-ring seal 28 between the lower edge 30 of the pump cylinder and a groove 32 dimensioned and configured to accommodate the O-ring so as to form a static seal. To enhance the integrity of the seal, a circumferential raised annulus 34 on the pump cylinder is seated on the upper edge 36 of the raised collar 18 when assembled. Collectively, these elements comprise the lower structural closure of the base end of the pump. A circular recess 38 in the upper surface of the base accommodates and centers the terminal lower ring of a conical helical compression spring 40.

The upper end 42 of the pump cylinder 22 provides support structure for the reciprocating piston as well as operational structure for the inlet valve. It includes a collar 44 having interior threads 46 which mate with complementary circumferential threads 48 on a pump cap 50. The cap 50 is a sturdy ring structure that includes four evenly spaced air inlet ports 52, a knurled edge 54 to facilitate gripping, and a center hole 56 which accommodates a guide bushing 58. The cap seats onto an annular filter element 60 disposed under and covering the air inlet ports and supported by a retainer ring 62 having circumferential tabs 64 which snap into a channel on the interior side 66 of the pump cylinder 22. The filter retainer secures the filter element snuggly against the underside of the cap and includes a plurality of holes 67 that allow inflowing air to pass through to the interior of the pump cylinder. It should be noted that all intake air must pass through the filter element.

A hollow cylindrical piston rod 68, open at each end, inserts through the guide bushing and threadably connects at its lower end 70 to a piston head 72 having a dentate rim 74. The spaced teeth 76 also allow passage of intake air. Beneath the rim 74 is a lower ridge 78 that defines a circumferential O-ring groove 80 in which a resilient and deformable piston ring 88 is disposed. The piston ring 88 engages the interior wall 25 of the pump cylinder. The piston head includes air passages 90 that allow the passage of inflowing air coming from the inlet ports 52 into the pump cylinder interior volume when the piston head is moving upwardly during the suction (air intake) cycle. A foot platform 94 is threadably screwed onto the piston rod at its upper end, and the opening is closed with a piston plug 96, in any of a number of readily removable configuration—threaded, bayonet, snap-fit, etc. Advantageously, the plug is easily removed and opens to the piston rod interior, thus providing storage space for small articles, such as patch kits and wrenches. The foot platform has a spoke and wheel configuration with a plurality of thick spokes 94*a* radially disposed from the platform center, or hub 94*b*, and surrounded by a circumferential rim 94*c*. Collectively, the elements comprising the foot platform provide a large effective surface area for a user's foot to engage the pump as well as structure for use in attaching the pump to the docking frame 140, described more fully below.

Figure 6:
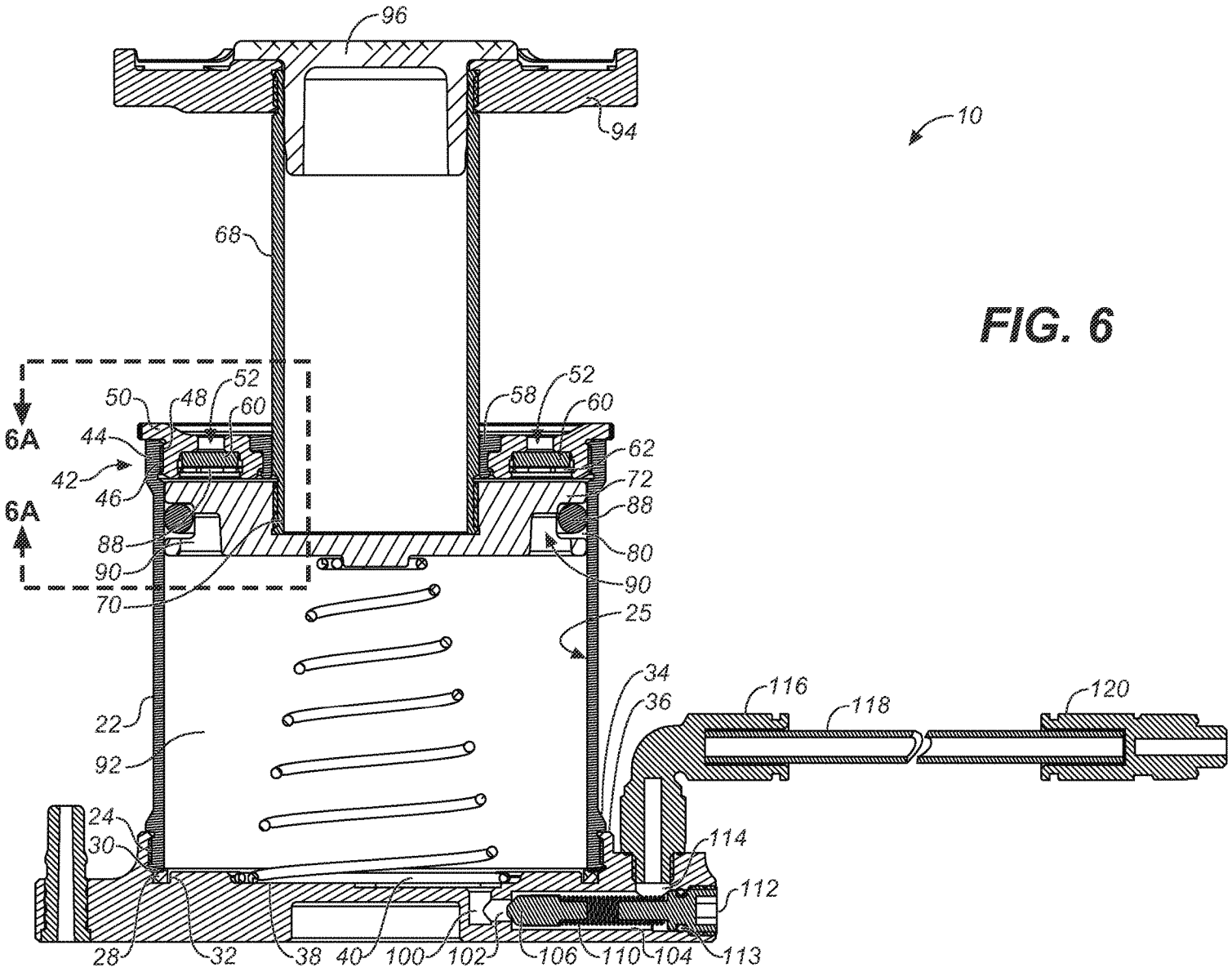
FIG. 6 is a cross-sectional left side view in elevation.
Figure 6A:
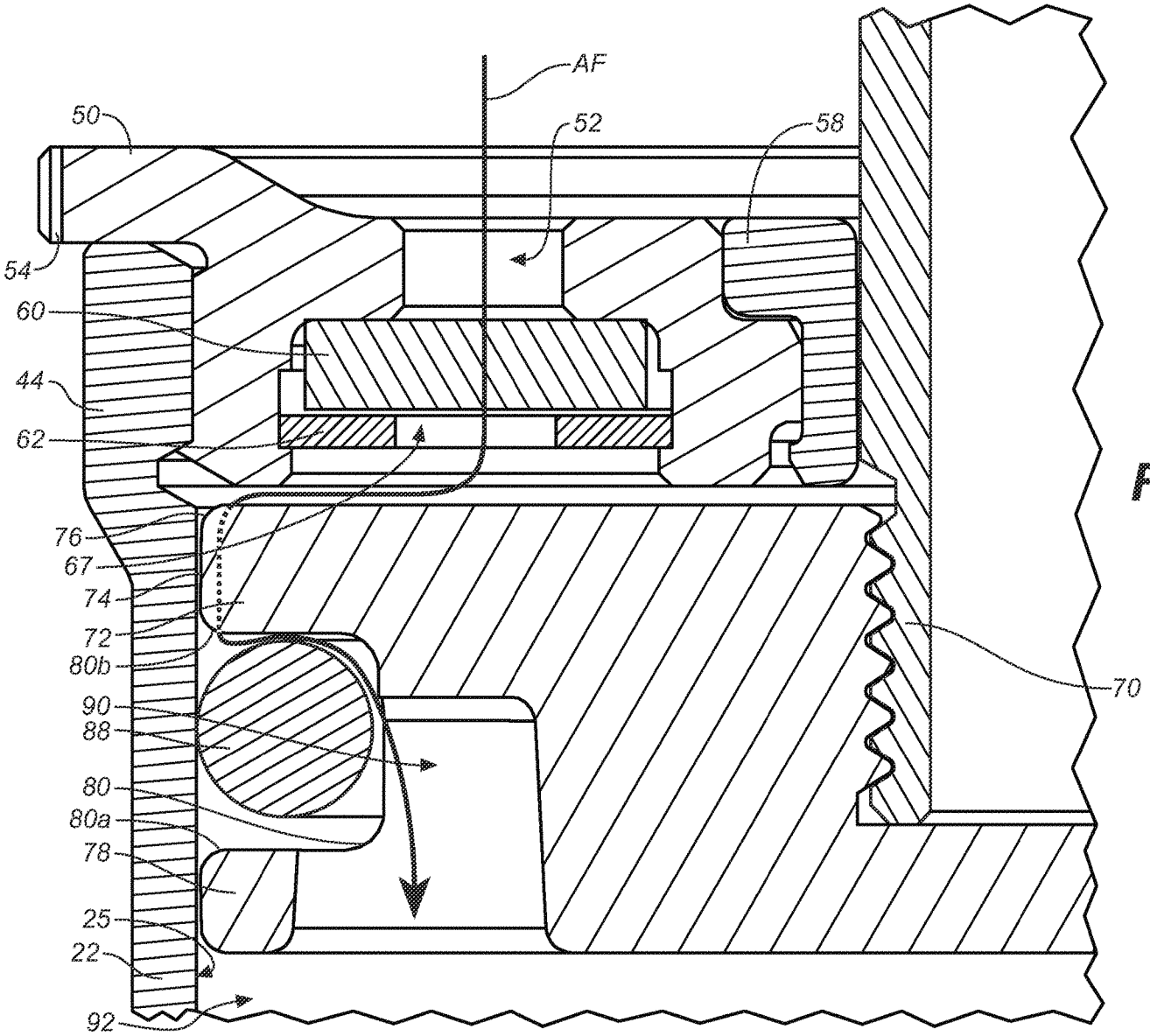
FIG. 6A is a detailed cross-sectional side view in elevation taken along section line 6A-6A of FIG. 6.

Operationally, and looking now at FIG. 6A, the piston ring cooperates with the inlet ports to function as the inlet valve. Specifically, during the suction stroke, stiction causes the piston ring 88 to roll slightly as the piston head moves up until it is urged against the bottom portion 80*a* of groove 80, causing it to compress slightly and deform down in groove 80 and thereby to provide clearance between piston ring 88 and the upper portion 80*b* of groove 80 so as to bring the pump cylinder interior volume into fluid communication with outside air (atmosphere). The low pressure created creates air flow AF through the now continuous passage, through air inlets 52, through filter element 60 and filter retainer 62, down and over piston head 72, further down through the passages defined by the space between teeth 74, into the O-ring groove 80, over piston ring 88, and into and through passage 90 and into the interior volume 92 of the pump. When the suction stroke is completed and the piston rod is driven down by a press on the foot platform, the piston head moves down, and stiction again moves the piston ring, this time upwardly, thereby closing the opening to air passage 90 and sealing the pump cylinder interior, such that the delivery stroke can be made without pressure loss or leaks.

Figure 2:
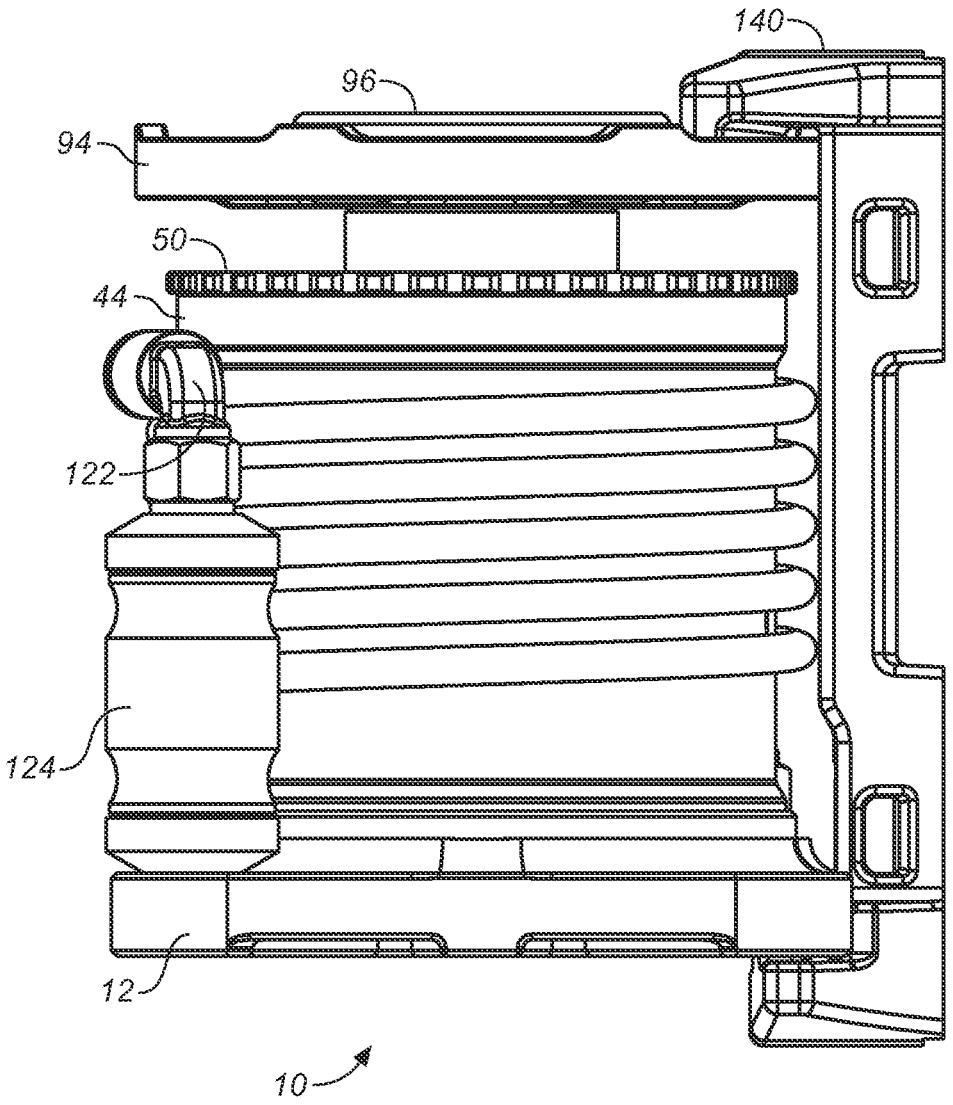
FIG. 2 is a right side view in elevation thereof.
Figure 3:
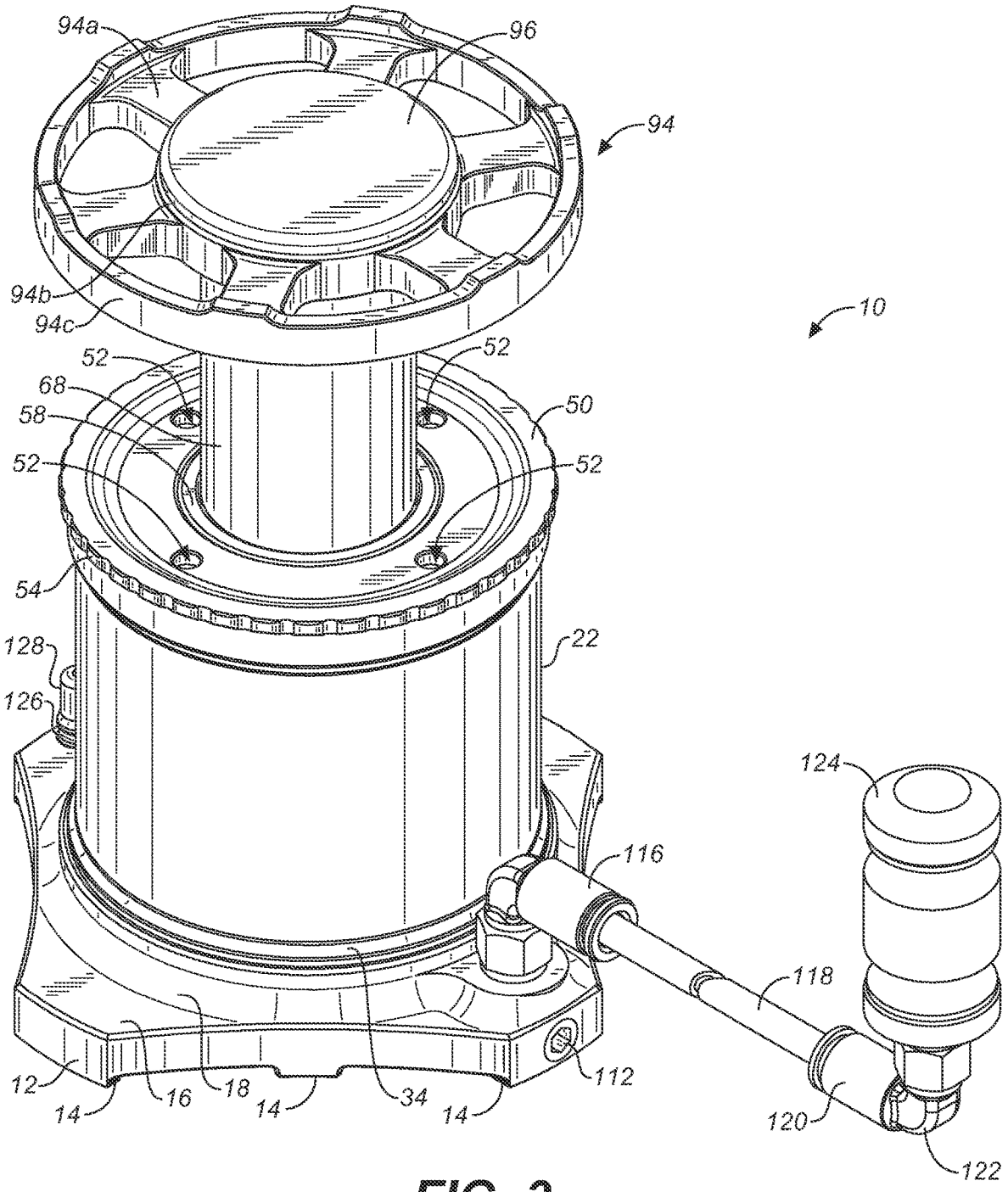
FIG. 3 is an upper front perspective view showing the pump removed from the frame and the hose unwound and deployed for use.
Figure 4:
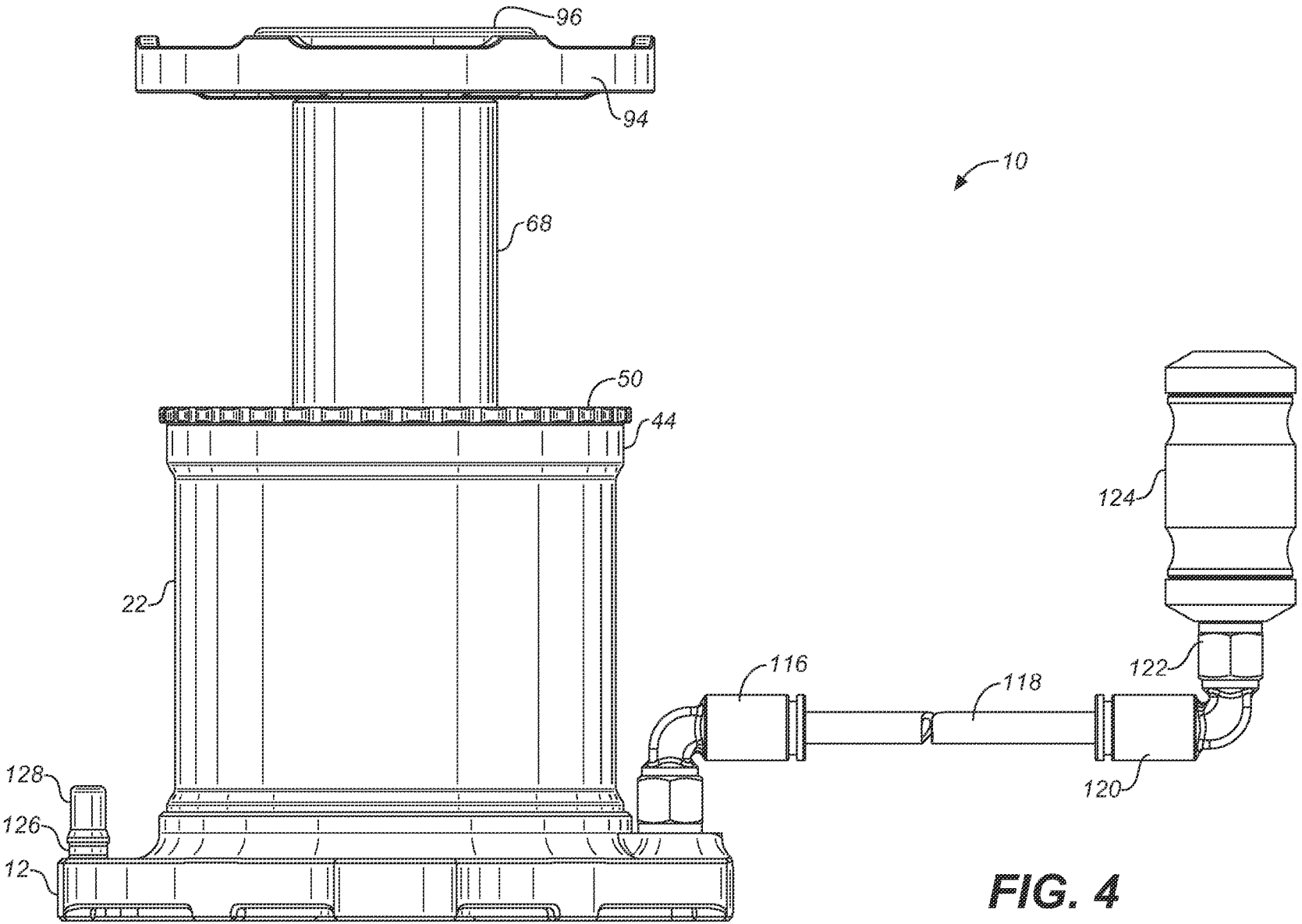
FIG. 4 is a left side view in elevation thereof.
Figure 5:
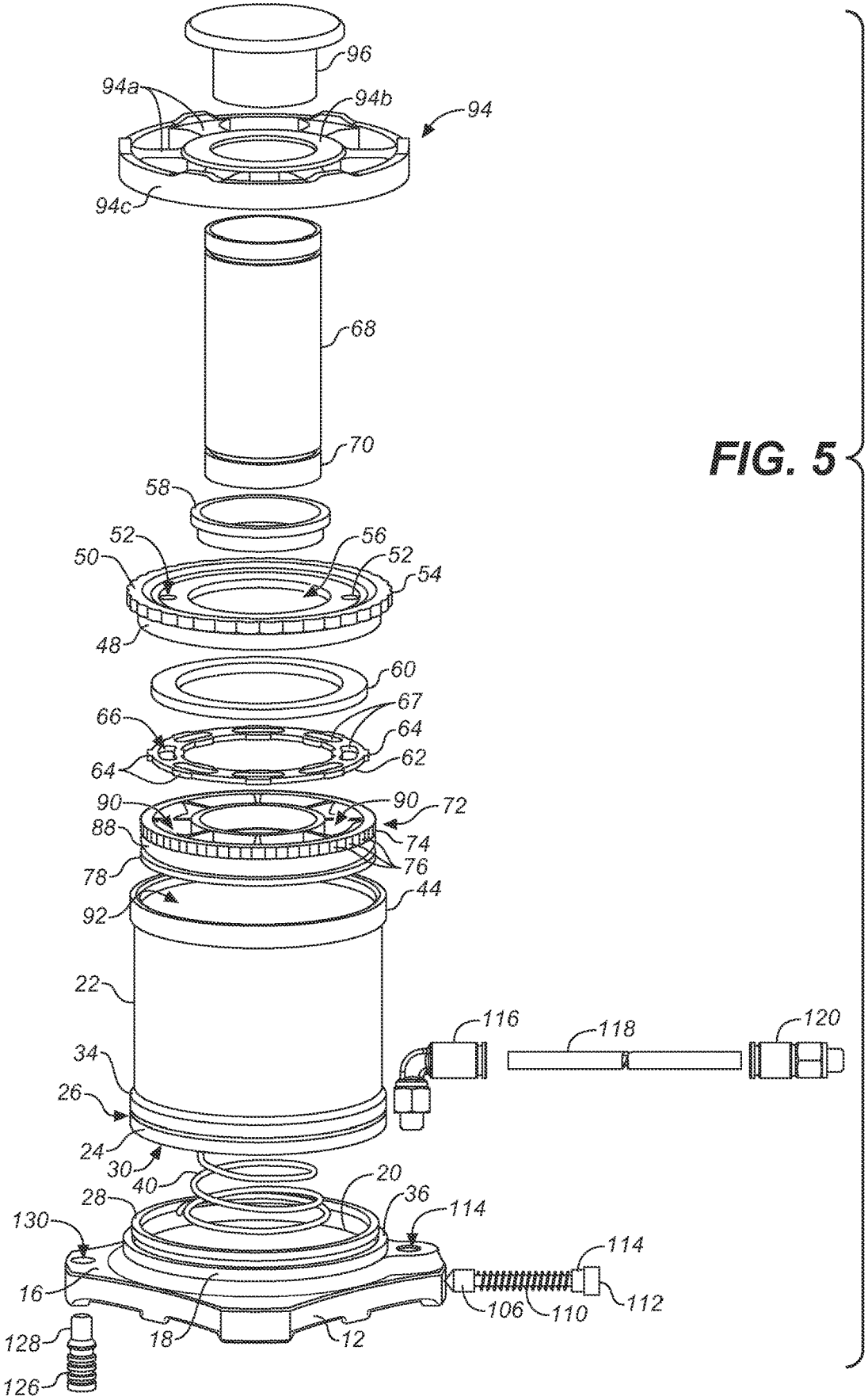
FIG. 5 is a left front exploded perspective view.

The discharge port and discharge valve reside in the base of the pump. An outlet port 100 in fluid communication with the pump cylinder interior volume extends downwardly from the top 16 of the base (i.e., the floor of the pump cylinder interior when assembled), bends in an el 102 to extend in a larger diameter horizontally oriented bore 104 to and through an edge of the base to form an outlet to the outside atmosphere. A check needle 106 is urged against the opening 108 by a check valve spring 110, the valve assembly sealed in the bore by a sealing screw and O-ring 113, and opens selectively on the delivery stroke of the piston in a manner well known in the art. Air flows around the check valve and down the bore along the check valve spring before exiting an air line outlet 114 onto which a first (inboard) right angle push-to-connect fitting 116 is coupled. A hose 118 extends and connects to a second push-to-connect fitting 120 and an (outboard) right angle fitting 122, onto which a reversible presta/Schrader valve chuck 124 is coupled. The valve chuck is stowed on barbed post 126 with a push-to-connect male element 128 inserted through an opening 130 in the base, facilitating a more compact and secure stow configuration (see esp. FIGS. 1-2 for the stow configuration) . The pump is mounted on a docking frame 140 configured for coupling to a bicycle frame using water bottle cage bosses.

Figure 8:
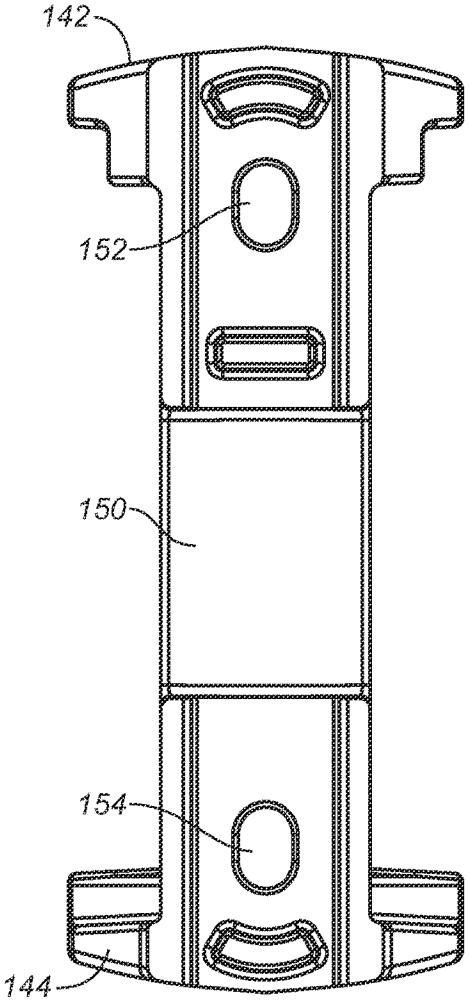
FIG. 8 is a rear view in elevation thereof.
Figure 7:
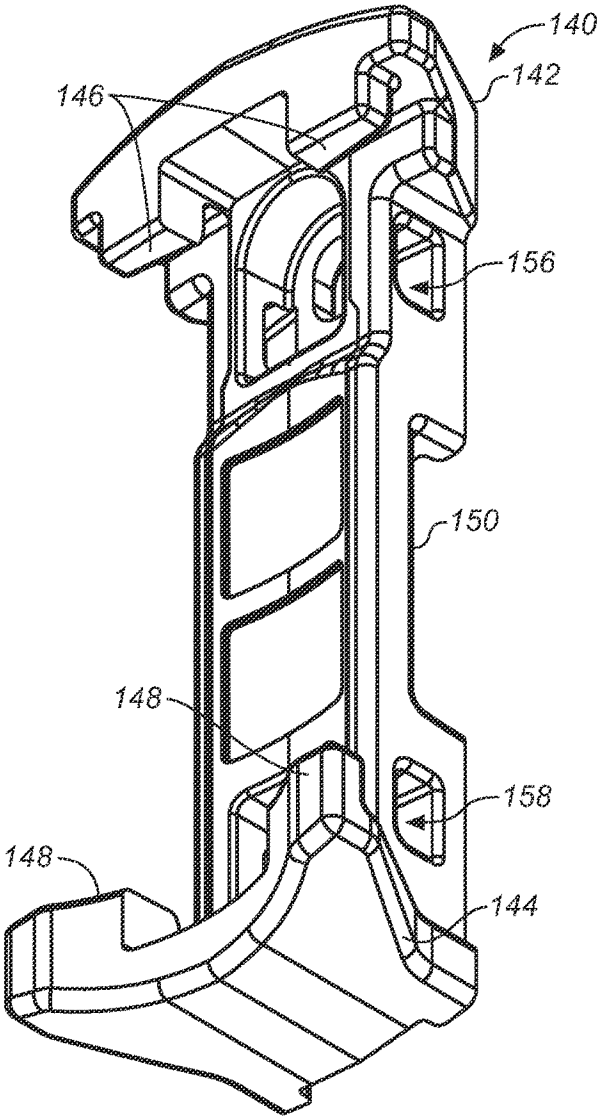
FIG. 7 is a lower front right perspective view of the docking frame used for stowing the inventive foot pump on a bicycle frame.

Accordingly, and referring now at FIGS. 7-8, there is shown a lightweight injection molded thermoplastic docking frame 140 having upper and lower arms 142, 144, each with fingers 146, 148, spaced so as to capture an edge of the base 12 and the rim 94*c* of the foot platform 94 when the pump is in a fully compressed configuration. In that configuration, the pump spring 40 will urge the piston head 72 and piston 68 rod upwardly to bring it into captured engagement with the docking frame. Orienting the base for installation on the docking frame is rapid and simple, as the base is uniformly shaped on several sides, each of which will position the presta/Schrader chuck off and away from the docking frame when the pump is installed.

The body portion 150 of the docking frame includes through holes 152, 154 spaced apart to match standard M5 (metric 5 mm) braze-on or rivet nut bottle cage mounts or bosses. In this way, no modifications of any kind are required to mount the docking frame or the pump on the bike. If bottle cage mounts are not available or it is preferred to mount the pump on frame space elsewhere, upper and lower cable tie holes 156, 158 are provided, through which heavy duty cable ties may be passed and tightly cinched to secure the docking frame to the bike frame.

From the foregoing, it will be seen that in its most essential aspect, the present invention is a single-acting reciprocating positive-displacement foot pump that includes: a base with a top side and a substantially planar bottom side, the top side having an air outlet port leading through an air passage to an airline outlet and a raised threaded collar; a check valve disposed in the air passage preventing ambient air from passing through the air passage; a pump cylinder defining an interior volume and having a lower end threadably connected to the raised threaded collar; a cap removably coupled to the upper end of the pump cylinder and having a plurality of air inlets; a piston including a piston rod with a lower end and an upper end; a piston head coupled to the lower end of the piston rod and having a plurality of air channels; a foot platform disposed on the upper end of the piston rod; a retainer ring disposed under the cap and having a plurality of through holes; a replaceable air filter element disposed between the air inlets in the cap and the retainer ring and the interior volume of the pump cylinder; wherein the air inlets, the filter element, the through hole in the retainer ring, and the air channels in the piston head are configured to create a continuous passage; a spring disposed between the base and the piston head; and a deformable seal disposed on the piston head; wherein the deformable seal moves into an air intake configuration to place the interior volume in fluid communication with ambient air through the continuous passage during a suction stroke and moves into an air delivery configuration to close the interior volume to fluid communication with ambient air through the continuous passage.

The above disclosure will enable one of ordinary skill in the art to practice the invention. The disclosure provides a disclosure of embodiments of the invention. However, the embodiments do not limit the invention to the exact construction, dimensional relationships, and operation shown and described. Modifications, alternative constructions, changes and equivalents will readily occur to those skilled in the art and may be employed, as suitable, without departing from the true spirit and scope of the invention.

Therefore, the above description and illustrations should not be construed as limiting the scope of the invention, which is defined by the appended claims.

What is claimed as invention is:

1. A low profile foot pump, comprising:

a base configured with a substantially planar support portion to rest stably on a flat surface and having an air outlet port, an airline outlet, an air passage therebetween, and a check valve disposed in said air passage;

a pump cylinder having an upper end and a lower end, said lower end sealingly and removably coupled to said base, said pump cylinder having an interior side and an interior volume, said interior volume in fluid communication with said air outlet port of said base;

a cap removably coupled to said upper end of said pump cylinder, said cap configured with a center hole to provide support structure for a reciprocating piston;

a piston having a piston rod slidingly disposed through said center hole, said cap further including a plurality of air inlet ports disposed around said center hole, said piston rod having an upper end and a lower end;

a foot platform disposed on said upper end of said piston rod;

an annular air filter element;

a retainer ring disposed under and spaced apart from said cap in a position fixed in relation to said cap so as to capture said air filter element, said retainer ring having a plurality of through holes;

a piston head affixed to said lower end of said piston rod and having air channels disposed through said piston head and around its circumference, a circumferential O-ring groove and a deformable piston O-ring disposed in said circumferential O-ring groove, said circumferential O-ring groove in fluid communication with said air channels, and said air channels in fluid communication with said through holes in said retainer ring, said piston O-ring sized so as to create static friction between said piston O-ring and said interior side of said interior side of said pump cylinder; and a spring disposed between said base and said piston head; wherein said circumferential O-ring groove is configured such that upon a suction stroke said piston O-ring moves to bring said interior volume of said pump cylinder into fluid communication with outside air and closes said check valve to prevent the passage of air from said airline outlet into said interior volume, and upon a delivery stroke said piston O-ring moves to prevent outside from entering said interior volume and drives air from said interior volume through said air outlet port, through said air passage and past said check valve, and through said airline outlet.

2. The foot pump of claim 1, wherein said plurality of through holes in said retainer ring cooperate with said plurality of air inlet ports so as to bring said interior volume of said pump cylinder into fluid communication with outside air, said air filter element imposed therebetween, such that all intake air must pass through said filter element.

3. The foot pump of claim 1, wherein said piston rod comprises a hollow cylinder open at a top end and defining an interior storage space, and a removable cap disposed on said top end.

4. The foot pump of claim 1, further including a bushing disposed in said center hole between said cap and said piston rod and threadably connected to said cap.

5. The foot pump of claim 1, wherein said piston head is threadably connected to said lower end of said piston rod.

6. The foot pump of claim 1, wherein said foot platform includes a hub threadably screwed onto said upper end of said piston rod and includes an outer rim connected to said hub with a plurality of spokes.

7. The foot pump of claim 1, further including a docking frame configured for coupling to a bicycle frame using standard water bottle cage bosses.

8. The foot pump of claim 7, wherein said docking frame includes an upper arm having a finger for capturing said foot platform, and a lower arm having a finger for capturing an edge of said base, wherein said spring urges said piston rod up so as to maintain said foot pump securely in said docking frame.

9. The foot pump of claim 1, further including a first push-to-connect fitting coupled to said airline outlet, a hose extending from said first push-to-connect fitting to a second push-to-connect fitting onto which a reversible presta/Schrader valve chuck is coupled.

10. A single-acting reciprocating positive-displacement foot pump, comprising:

a base with a top side and a substantially planar bottom side, said top side having an air outlet port leading through an air passage to an airline outlet and a raised threaded collar;

a check valve disposed in said air passage preventing ambient air from passing through said air passage;

a pump cylinder defining an interior volume and having a lower end threadably connected to said raised threaded collar;

a cap removably coupled to said upper end of said pump cylinder and having a plurality of air inlets;

a piston including a piston rod with a lower end and an upper end;

a piston head coupled to said lower end of said piston rod and having a plurality of air channels;

a foot platform disposed on said upper end of said piston rod;

a retainer ring disposed under said cap and having a plurality of through holes;

a replaceable air filter element disposed between said air inlets in said cap and said retainer ring and said interior volume of said pump cylinder;

wherein said air inlets, said filter element, said through hole in said retainer ring, and said air channels in said piston head are configured to create a continuous passage;

a spring disposed between said base and said piston head; and a deformable seal disposed on said piston head;

wherein said deformable seal moves into an air intake configuration to place said interior volume in fluid communication with ambient air through said continuous passage during a suction stroke and moves into an air delivery configuration to close said interior volume to fluid communication with ambient air through said continuous passage.

11. The foot pump of claim 10, wherein said deformable seal is an O-ring disposed in a circumferential channel surrounding said piston head.

12. The foot pump of claim 11, wherein said O-ring changes its configuration between a suction stroke and a delivery stroke through stiction.

13. The foot pump of claim 12, further including a docking frame mountable on a bicycle frame and configured with first and second arms that capture said foot pump by clasping said foot platform and said base, wherein said spring urges said foot platform and said base into engagement with said first and second arms.

14. The foot pump of claim 13, wherein said docking frame is configured to mount on standard water bottle bosses.

15. The foot pump of claim 10, wherein said foot pump has a displacement volume of approximately 78 $cm^3$.

* * * * *